US006695496B2

(12) United States Patent
Nakagaki et al.

(10) Patent No.: US 6,695,496 B2
(45) Date of Patent: Feb. 24, 2004

(54) DOT PRINTER

(75) Inventors: Yuji Nakagaki, Chiba-ken (JP); Mitsuharu Shishido, Chiba-ken (JP)

(73) Assignee: Seiko Precision Inc., Chiba-ken (JP)

( * ) Notice: Subject to any disclaimer, the term of this patent is extended or adjusted under 35 U.S.C. 154(b) by 0 days.

(21) Appl. No.: 09/758,826

(22) Filed: Jan. 11, 2001

(65) Prior Publication Data

US 2001/0010773 A1 Aug. 2, 2001

(30) Foreign Application Priority Data

Jan. 27, 2000 (JP) ..... 2000-018310

(51) Int. Cl.[7] ..... B41J 33/32

(52) U.S. Cl. ..... 400/124.1; 400/124.01; 400/247; 400/659; 400/662; 101/93.05

(58) Field of Search ..... 101/93.04, 93.05, 101/93.15, 93.16; 400/124.01, 124.1, 656, 659, 662, 247, 248, 248.1, 470

(56) References Cited

U.S. PATENT DOCUMENTS 4,056,183 A * 11/1977 Beery ..... 101/310
4,069,755 A * 1/1978 Beery ..... 101/90
4,133,262 A * 1/1979 Beery ..... 101/101
4,556,333 A * 12/1985 Stefansson ..... 400/470
4,697,941 A * 10/1987 Takenoya et al. ..... 400/185
4,702,629 A * 10/1987 Hamano et al. ..... 400/56
4,893,952 A * 1/1990 Svyatsky ..... 400/470
5,154,521 A * 10/1992 Tanaka et al. ..... 400/247
5,186,554 A * 2/1993 Mizutani et al. ..... 400/208
5,810,489 A 9/1998 Nakagaki et al.
6,244,768 B1 * 6/2001 Chang et al. ..... 400/662
6,261,008 B1 * 7/2001 Omura ..... 400/58
6,294,038 B1 * 9/2001 Majkrzak ..... 156/238

FOREIGN PATENT DOCUMENTS

JP 55-017588 2/1980

* cited by examiner

*Primary Examiner*—Stephen R. Funk
*Assistant Examiner*—Kevin D. Williams
(74) *Attorney, Agent, or Firm*—Jordan and Hamburg LLP

(57) ABSTRACT

A dot printer not using any type, nor requiring any ink ribbon has an ink roller 1, a platen 2 having an outer surface coated with ink by contacting the ink roller 1, and a printing head 3 facing the platen 2 in an appropriately spaced apart relation thereto. The printing head 3 is a dot impact type printing head having a plurality of printing wires caused to project selectively to form letters, and a recording medium 6 is conveyed between the platen 2 and the printing head 3 to have printing made thereon by the printing head 3. A protective film 8 is employed between the printing head 3 and the recording medium 6.

3 Claims, 2 Drawing Sheets

PRIOR ART

DOT PRINTER

BACKGROUND OF THE INVENTION

1. Field of the Invention

This invention relates to a dot printer, and more particularly, to a printer which does not use any type, or require any ink ribbon.

2. Description of the Related Art

An ink ribbon has usually been used in a dot printer to transfer ink onto a recording medium to form letters, etc. thereon. A printer using an ink melted by heat has been of the kind using types, since the ink is required to dry quickly. It has a type stocker not shown, but keeping a stock of types 'a' for letters, symbols, etc. to be printed, and a type wheel 'b' on which types for letters, symbols, etc. to be printed can be mounted, so that the types 'a' required for printing may be taken out of the type stocker manually, and mounted on the type wheel 'b', as shown in FIG. 2. For printing, the type stocker and the type wheel 'b' are heated by a heater 'c' so that the types 'a' may be heated, and an ink roller 'd' holding an ink melted by heat is heated by a heater 'e' to have the ink melted. The types 'a' are brought into contact with the ink roller 'd' to have their surfaces coated with the ink, and transfer the ink onto a printing medium 'g' conveyed by a printing medium feed roller 'f'. The ink transferred onto the printing medium 'g' is allowed to cool and solidify immediately at room temperature to form letters, etc. The types 'a' on the type wheel 'b' are changed to those which are taken out of the type stocker manually as required and are mounted on the type wheel 'b' by any change of the matter to be printed.

A printer using an ink ribbon as a source of ink supply is, however, expensive to maintain, since it requires a frequent change of ink ribbons. A type printer has been large and very expensive, since it is required to keep a stock of many types in its type stocker and requires a mechanism for changing types. Moreover, a change of types has required a complicated manual job bringing about an increase of cost.

SUMMARY OF THE INVENTION

According to this invention, there is provided a dot printer which comprises an ink holding member, a platen having an outer peripheral surface coated with ink by contacting the ink holding member, and a printing head facing the platen in an appropriately spaced apart relation thereto. The printing head is a dot impact type printing head having a plurality of printing wires caused to project selectively to form letters, and a recording medium is conveyed between the printing head and the platen to have printing made thereon by the printing head. The printing head, which is of the dot impact type, does not require any complicated job for mounting or changing types. The printer can form uniform dots easily and is easy to supply with ink, since the dots are formed by the printing wires projecting and pressing the recording medium against the ink-coated outer peripheral surface of the platen.

A protective film may be situated between the printing head and the recording medium for protecting the recording medium. It protects the recording medium from any damage caused by the printing wires projecting against it.

The ink holding member may hold an ink melted by heat, and the ink holding member and the platen may each be provided with a device for heating the ink to its melting temperature. The ink melted by heat is easy to handle, since it readily solidifies at room temperature after its transfer onto the recording medium.

The ink holding member is preferably an ink roller having a source of heat located inside, and a member surrounding it and impregnated with the ink melted by heat, since it is easy to handle, or change to a new one in the case of ink shortage, etc.

The apparatus of this invention as described is small and inexpensive, as it does not require any large mechanism for changing types, etc. It does not require any complicated job for mounting or changing types, etc., but can easily form uniform dots, and is easy to supply with ink. A protective film can be relied upon for protecting the recording medium from any damage caused by the printing wires projecting against it. An ink melted by heat is easy to handle, as it readily solidifies at room temperature after its transfer to the recording medium. An ink roller is easy to handle, and easy to change to a new one when it has run short of ink. A drastic reduction of printing time can be obtained if there is a frequent change of the matter to be printed.

DETAILED DESCRIPTION OF THE INVENTION

Figure 1:
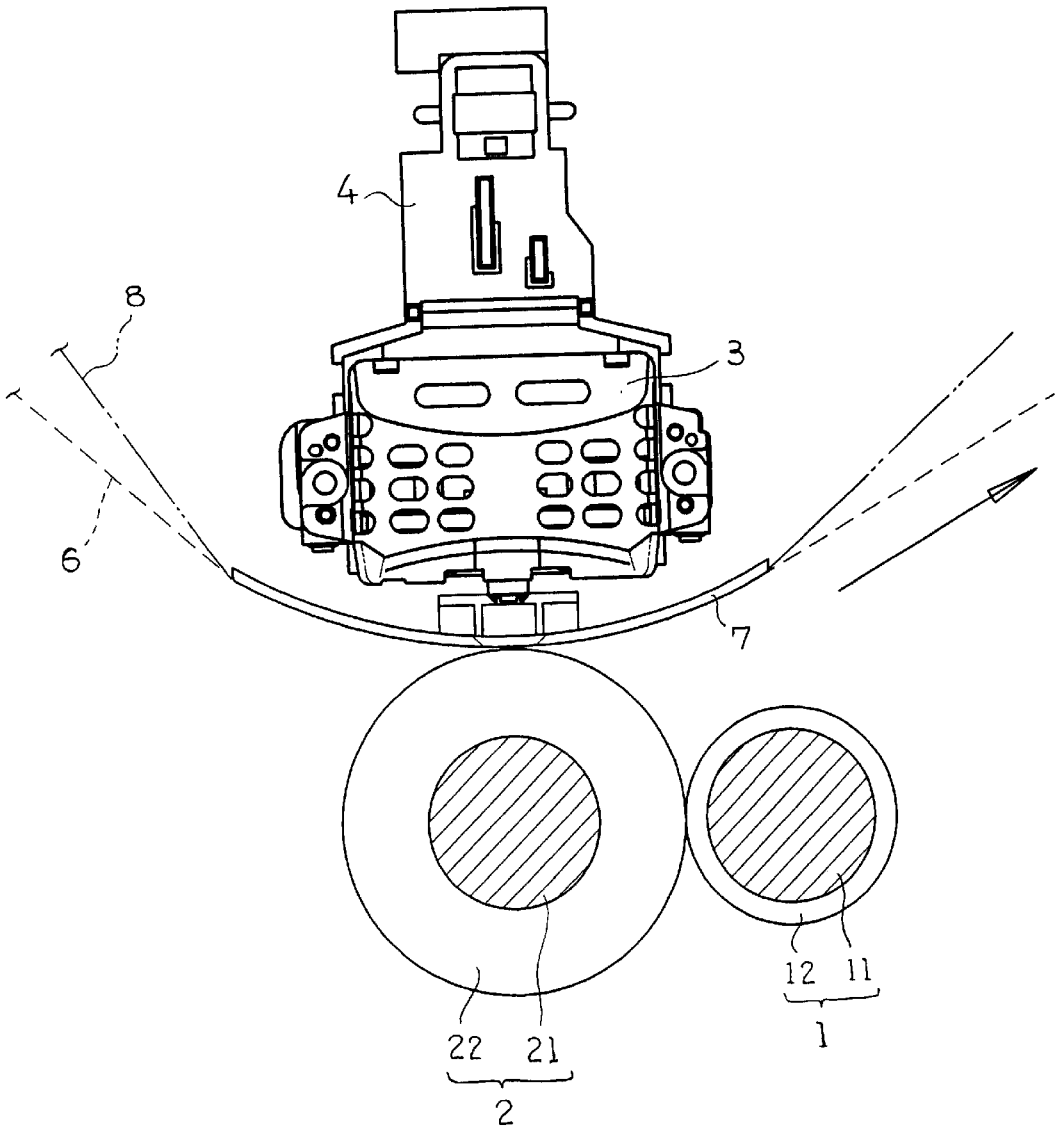
FIG. 1 is a front elevational view illustrating a printer embodying this invention.
Figure 2:
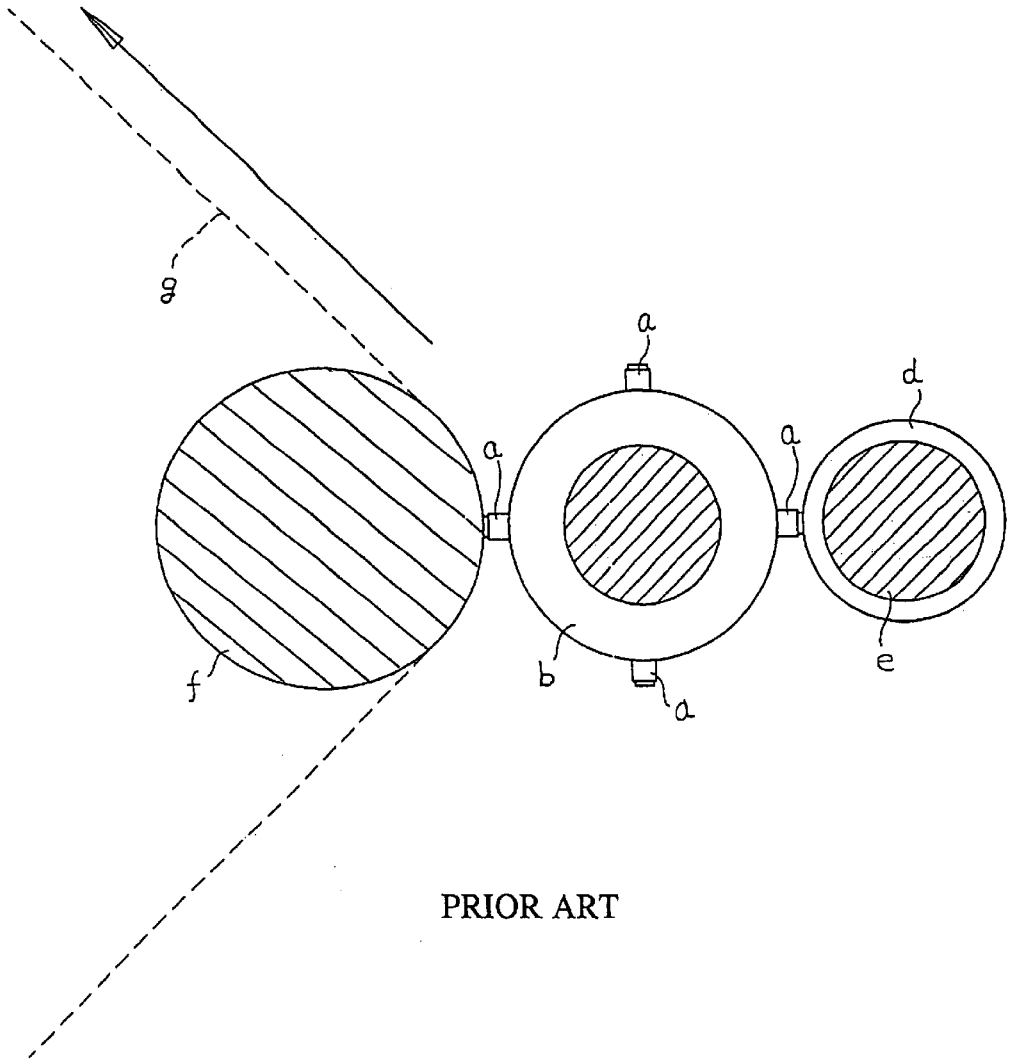
FIG. 2 is a front elevational view outlining the construction of a known type printer.

A printer embodying this invention will now be described with reference to the drawings. Referring to FIG. 1, an ink roller 1 is employed as an ink holding member. The ink roller 1 has a heater 11 inside as a heating device, and a roller 12 formed around it by winding e.g. a urethane foam as a member which is easy to impregnate with an ink melted by heat. A platen 2 has a heater 21 inside as a heating device, and is always kept at a high temperature to avoid the solidification of the molten ink on the surface of a roller 22 surrounding the heater. The platen 2 has such a length extending perpendicularly to the plane of FIG. 1 as to face a printing head 3 wherever the latter may travel, as will be described later. The ink roller 1 likewise has such a length extending perpendicularly to the plane of FIG. 1 as to stay in resilient contact with the platen 2 and be rotatable with the platen 2 to feed its outer peripheral surface with ink.

The printing head 3 is of the dot impact type having a plurality of printing wires not shown, but capable of being caused to project selectively to form dots and thereby print letters, etc. The printing head 3 is mounted on a carriage 4. The carriage 4 is movable along a guide member not shown in a direction perpendicular to the plane of FIG. 1. The carriage 4 is also movable to and away from the platen 2 by a mechanism not shown to enable the adjustment of the gap between the platen 2 and the printing head 3.

A recording medium guide member 7 for guiding a recording medium 6 is situated on that side of the printing head 3 which faces the platen 2. The recording medium 6 is supplied from left top as viewed in FIG. 1, and a protective film 8 is supplied with the recording medium 6. The protective film 8 lies on the recording medium 6 so as to extend between the printing head 3 and the recording medium 6, and passes between the platen 2 and the printing head 3 in contact with the recording medium guide member 7, while remaining on the recording medium 6.

If the printing head 3 is fed with a drive signal for driving printing wires for forming a desired letter, etc. while the recording medium 6 is traveling along the recording medium guide member 7, the selected printing wires project from the printing head 3 and press a portion of the recording medium 6 into contact with the platen 2, so that the ink melted by heat on the surface of the platen may be transferred onto the recording medium 6 to form the letter, etc. thereon. The protective film 8 lying between the printing head 3 and the recording medium 6 protects the recording medium 6 from any damage caused by the printing wires striking against it. The heat-molten ink separated from the platen 2 by adhering to the recording medium 6 is immediately allowed to cool and solidify at room temperature.

Since letters, etc. are formed on the recording medium 6 as described, a change of the matter to be recorded requires only a change of the drive signals to be fed to the printing head 3, and does not require any such work as a change of types.

Although an ink roller is shown as an ink holding member in FIG. 1, it is not limitative, but may be replaced by any of various other arrangements including a tank storing an ink melted by heat and positioned under the platen so that a portion of the platen may always remain in contact with the ink.

What is claimed is:

1. A dot printer comprising:

an ink holding member, said ink holding member holding an ink melted by heat, a platen having an outer peripheral surface coated with ink by contacting said link holding member, said ink holding member and said platen each being provided with means for heating said ink to its melting temperature, a printing head facing said platen in an appropriately spaced apart relation thereto, said printing head being a dot impact type printing head having a plurality of printing wires caused to project selectively to form letters, and a recording medium being conveyed between said printing head and said platen to have printing made thereon by said printing head.

2. A dot printer as set forth in claim 1, wherein said ink holding member is an ink roller having a source of heat located inside and a member surrounding it and impregnated with said ink.

3. A dot printer comprising:

an ink holding member, a platen having an outer peripheral surface coated with ink by contacting said ink holding member, a printing head facing said platen in an appropriately spaced apart relation thereto, said printing head being a dot impact type printing head having a plurality of printing wires caused to project selectively to form letters, a recording medium being conveyed between said printing head and said platen to have Printing made thereon by said Printing head and a protective film between said printing head and said recording medium for protecting said recording medium, wherein said ink holding member is an ink roller having a source of heat located inside and a member surrounding it and impregnated with said ink.

* * * * *